US007029452B1

(12) United States Patent
Alton, Jr.

(10) Patent No.: US 7,029,452 B1
(45) Date of Patent: Apr. 18, 2006

(54) ACOUSTICALLY-DRIVEN HYDROTHERAPY SYSTEM

(76) Inventor: Noyal John Alton, Jr., 2408 Eyre Hall Way, Virginia Beach, VA (US) 23456

( * ) Notice: Subject to any disclaimer, the term of this patent is extended or adjusted under 35 U.S.C. 154(b) by 525 days.

(21) Appl. No.: 10/371,494

(22) Filed: Feb. 20, 2003

Related U.S. Application Data

(60) Provisional application No. 60/359,289, filed on Feb. 20, 2002.

(51) Int. Cl.
*A61H 1/00* (2006.01)

(52) U.S. Cl. ..... 601/47; 601/55; 601/56; 601/57; 601/59

(58) Field of Classification Search ..... 601/46–47, 601/55–56, 148, 57, 59
See application file for complete search history.

(56) References Cited

U.S. PATENT DOCUMENTS 3,776,223 A * 12/1973 Yeager et al. ..... 601/157
5,695,455 A * 12/1997 Alton et al. ..... 601/47
6,139,512 A * 10/2000 Ricchio ..... 601/55

* cited by examiner

*Primary Examiner*—Michael A. Brown
(74) *Attorney, Agent, or Firm*—Peter J. Van Bergen

(57) ABSTRACT

A hydrotherapy system has a rigid tank filled with a liquid. At least one acoustic wave is impinged on the tank's exterior walls where it is coupled to the liquid for transmission therethrough. The acoustic wave interacts in the liquid with at least one of (i) a reflection of the acoustic wave from one of the tank's interior walls, and (ii) at least one other acoustic wave that was generated and impinged on another of the tank's exterior walls.

20 Claims, 3 Drawing Sheets

ACOUSTICALLY-DRIVEN HYDROTHERAPY SYSTEM

ORIGIN OF THE INVENTION

Pursuant to 35 U.S.C. § 119, the benefit of priority from provisional application 60/359,289, with a filing date of Feb. 20, 2002, is claimed for this non-provisional application.

FIELD OF THE INVENTION

The invention relates generally to hydrotherapy systems, and more particularly to a acoustically-driven hydrotherapy system in which a person's body or body part is immersed in a fluid-filled tank.

BACKGROUND OF THE INVENTION

In a wide variety of physical therapy applications, some form of massage is used to sooth and/or stimulate an injured area of one's body. Even though all massage therapies are initiated at the body's surface, the effects of some therapies are limited to areas at or near the skin's surface while the effects of other therapies are felt deeper within one's body.

Surface-effect therapies include those performed by a masseur, those involving immersion in tanks or hot/cold tubs in which the water is agitated by jets/pumps, and those performed using hand-held vibration devices, just to name a few. While these techniques generally feel very good and address soreness at or near one's surface musculature, these surface-based techniques are unable to have a large effect on muscles and/or nerves that lie further beneath the skin's surface.

Recognizing the benefits of internal muscle massage and nerve stimulation, the science of kinesiology has developed a variety of electrical and ultrasound systems/techniques that can be used to impact muscles and nerves located further in the body. Typically, electrodes or transducers are positioned on the person's skin and energy is applied thereto. Although this energy is delivered deeply into one's body, a burning sensation is often associated therewith. That is, while healing and/or stimulation is reaching the area of concern, the patient may experience a level of discomfort. Unfortunately, the discomfort felt during treatment can produce a counter-productive stress effect on the patient.

SUMMARY OF THE INVENTION

In accordance with the present invention, a hydrotherapy system has a rigid tank filled with a liquid. Acoustic means coupled to the tank cause at least one acoustic wave to impinge on the tank's exterior wall(s). The rigid nature of the tank causes the acoustic wave(s) to be coupled to the liquid for transmission therethrough. The acoustic wave(s) interact in the liquid with at least one of (i) a reflection of an acoustic wave from one of the tank's interior walls, and (ii) at least one other acoustic wave generated and impinging on another of the tank's exterior walls for transmission through the liquid.

BRIEF DESCRIPTION OF THE DRAWINGS

The features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
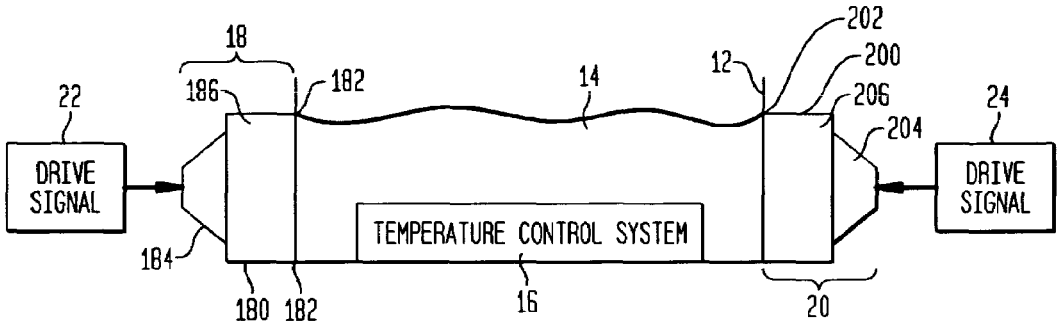
FIG. 1 is a schematic view of an embodiment of an acoustically-driven hydrotherapy system in accordance with the present invention.

Referring now to the drawings, and more particularly to FIG. 1, an acoustically-driven hydrotherapy system in accordance with an embodiment of the present invention is shown and referenced generally by numeral 10. It is to be understood at the outset that the size of hydrotherapy system 10 is not a limitation of the present invention. That is, hydrotherapy system 10 can be sized to treat a portion of one's body such as an arm or leg, one's entire body, or even a plurality of people at the same time.

Hydrotherapy system 10 includes an open-top, rigid tub or tank 12 filled with a liquid 14 which typically is plain water, but could also be other liquids such as a light oil, or water/oil mixed with materials that give liquid 14 a pleasant aroma. For reasons that will be explained further below, tank 12 can be made of any rigid material suitable for a particular application. For example, tank 12 could be made of stainless steel owing to its well known corrosion-resistance and hygienic properties. Tank 12 could also be made from any other suitable metal, fiberglass, plastic or even concrete.

Although not required for the present invention, a temperature control system 16 can be coupled to liquid 14 for purposes of heating or cooling liquid 14 to a desired temperature. Choices for temperature control system 16 could include, but are not limited to, a simple heating element, a heating/cooling liquid recirculation system, or any other liquid temperature control system known in the art.

Coupled and sealed to opposing exterior sides of tank 12 are acoustic systems 18 and 20. Acoustic system 18 includes an air-filled housing 180 sealed about its perimeter 182 to the exterior of tank 12. An acoustic driver 184 is mounted/sealed to housing 180 with one side thereof facing into housing 180 such that, when acoustic driver 184 is driven in a compressive mode, air in housing 180 is compressed. The backside of acoustic driver 184 cooperates with ambient air. The combination of housing 180, the portion of tank 12 enclosed by housing 180 and acoustic driver 184 define a sealed chamber 186. The rigid nature of tank 12 insures that the acoustic waves generated in chamber 186 are not attenuated by tank 12 but, rather, are coupled directly into liquid 14 for transmission therethrough. A similar construction exists for acoustic system 20 where analogous reference numerals in the 200's are used for the elements thereof.

Coupled to each of acoustic drivers 184 and 204 are drive signals 22 and 24, respectively. Drive signals 22 and 24 can originate from the same signal source or from independently-controlled signals sources. By way of non-limiting examples, a number of options for both signal sources and signals produced thereby will be described herein.

In each of FIGS. 2–6, drive signals associated with two independent signal sources are shown graphically on the left and right hand sides of each figure. Since the relative frequencies that are illustrated are not drawn to scale, each signal has been labeled in terms of its frequency. Drive signals 22 and 24 are converted by respective acoustic drivers 184 and 204 into acoustic waves having the same frequency characteristics as that of their drive signals. As mentioned above, the acoustic waves generated by acoustic drivers 184 and 204 are coupled directly into liquid 14 via tank 12. Since the acoustic waves are introduced into liquid 14 at opposing sides of tank 12 (i.e., corresponding interior sides of tank 12 are also opposing one another), the acoustic waves propagate towards one another and interact with one another in liquid 14. The results of such acoustic wave interaction is depicted graphically in each of the figures by the RESULTING SIGNAL graph. That is, the RESULTING SIGNAL graph represents the interaction in liquid 14 of the acoustic waves generated by acoustic systems 18 and 20.

By impinging acoustic waves on opposing sides of tank 12, the combined/resulting wave is located generally at the center portion of tank 12 where one's body or body part can be easily positioned and maintained. It is to be understood that use of the term "center portion of tank 12" refers generally to a central volume of tank 12 as opposed to the exact center of tank 12. It is to be further understood that the frequencies used in the description are for purposes of illustration only and that other frequencies can be used without departing from the scope of the present invention. Further, while the present invention will typically be used/driven by frequencies of approximately 100 hertz (Hz) or less, it is not so limited. That is, the lower frequencies will generally be selected for their ability to resonate liquid 14. However, higher frequencies may be used and/or added in for therapeutic coupling to one's body without the resonation of liquid 14.

Figure 2:
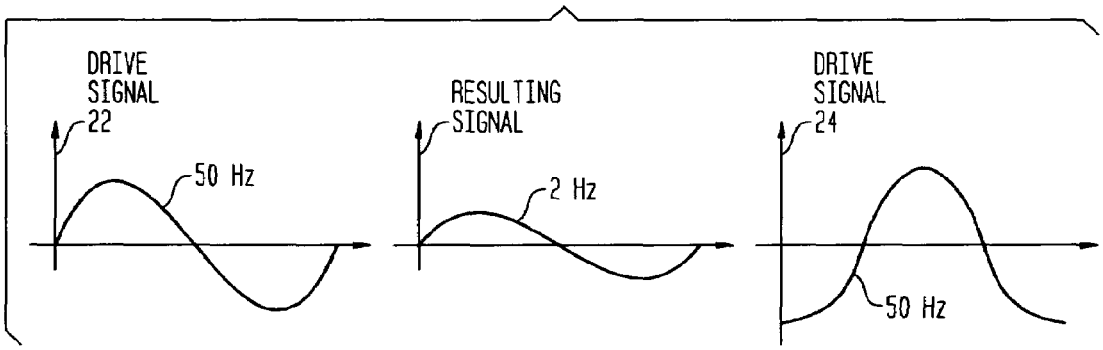
FIG. 2 depicts two out-of-phase drive signals of differing frequency and the resulting wave generated in the center portion of the present invention's tank.

In FIG. 2, drive signal 22 is a 50 Hz sine wave and drive signal 24 is a 52 Hz sine wave that is 90° out-of-phase with drive signal 22. The RESULTING SIGNAL at approximately the center of tank 12 is a 2 Hz sine wave that is in phase with drive signal 22.

Figure 3:
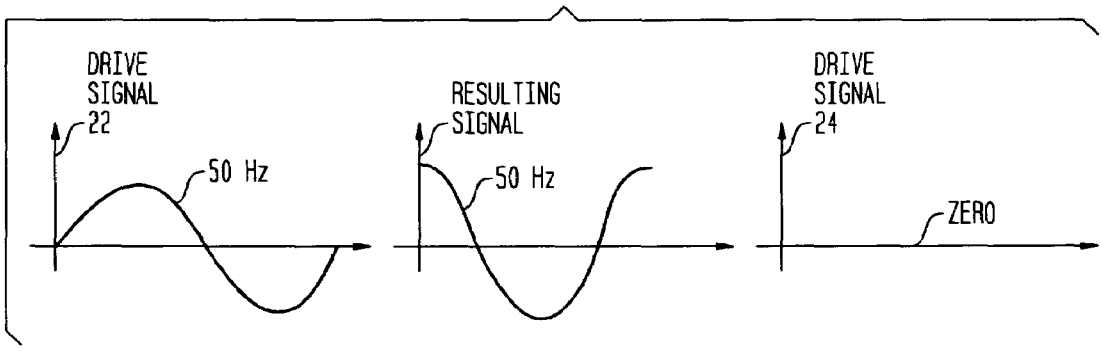
FIG. 3 depicts a sine wave and a d.c. signal for the drive signals and the resulting wave generated in the present invention's tank.

In FIG. 3, drive signal 22 is a 50 Hz sine wave while drive signal 24 is a zero drive signal, i.e., zero amplitude and frequency). The RESULTING SIGNAL at approximately the center of tank 12 is a 50 Hz sine wave that is 90° out-of-phase with drive signal 22 because of the reflection off the side of tank 12 that opposes acoustic system 18.

Figure 4:
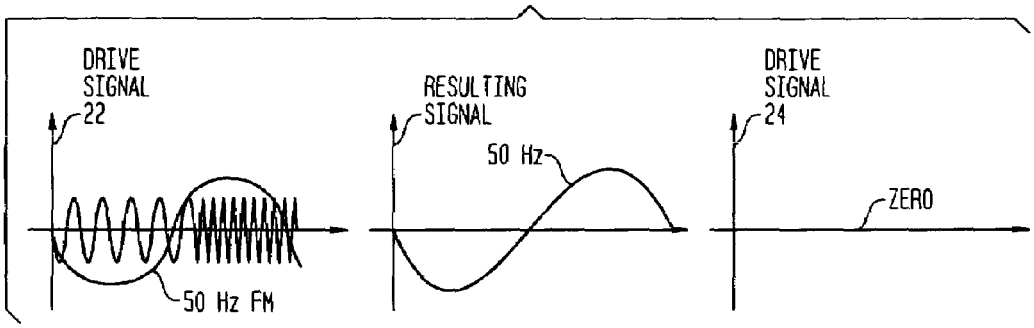
FIG. 4 depicts an FM wave and a d.c. signal for the drive signals and the resulting wave generated in the present invention's tank.

In FIG. 4, drive signal 22 is a 50 Hz frequency modulated (FM) wave while drive signal 24 is a zero d.c. drive signal. The RESULTING SIGNAL at approximately the center of tank 12 is a simple 50 Hz sine wave that is 90° out-of-phase with drive signal 22 for the same reasons as described above with respect to FIG. 3. The advantages of using an FM drive signal include the fact that FM provides a purer signal than a simple sine wave and that FM signals are easy to control.

Figure 5:
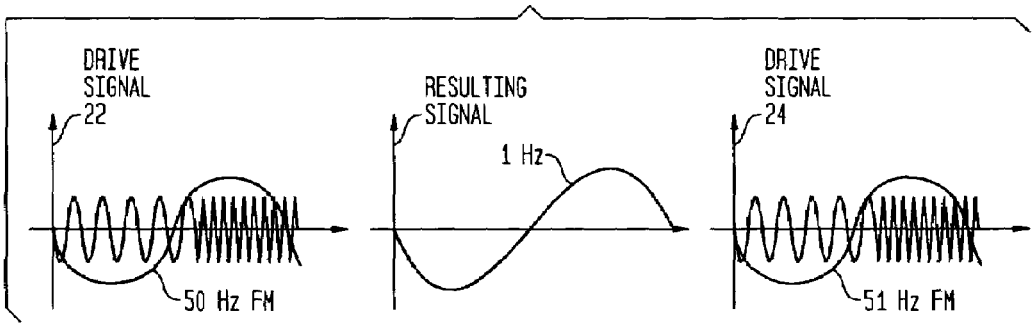
FIG. 5 depicts two FM waves of differing frequency for the drive signals and the resulting wave generated in the present invention's tank.

The FIG. 5 embodiment employs drive signal 22 that is a 50 Hz FM wave with zero frequency sweep while drive signal 24 is an in-phase 51 Hz FM wave with zero frequency sweep. The RESULTING SIGNAL at approximately the center of tank 12 is a simple in-phase 1 Hz sine wave. The use of FM sweeps provides for the production of very low resulting resonations as well as better control of these very low frequencies in terms of their stabilization and phase shifting.

Figure 6:
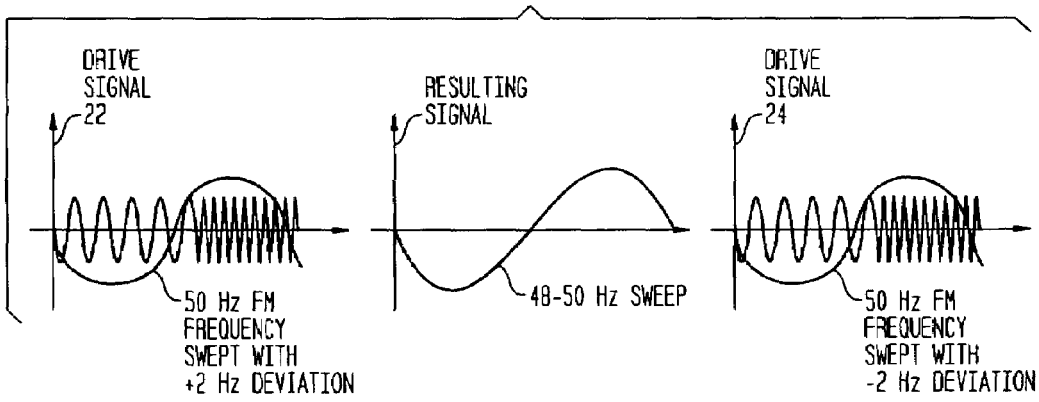
FIG. 6 depicts two same-frequency FM waves for the drive signals and the resulting wave generated in the present invention's tank.

In FIG. 6, drive signal 22 is a 50 Hz FM wave that is frequency swept with a +2 Hz deviation in frequency while drive signal 24 is a 50 Hz FM wave that is frequency swept with a −2 Hz deviation in frequency. The RESULTING SIGNAL at approximately the center of tank 12 is in the range of a 48–52 Hz sine wave sweep. This range depends on the relative phases between the drive signals. That is, if both drive signals are at their opposing extremes as dictated by the specified deviations, the resulting signal could be plus or minus the deviation from the target frequency.

Figure 7:
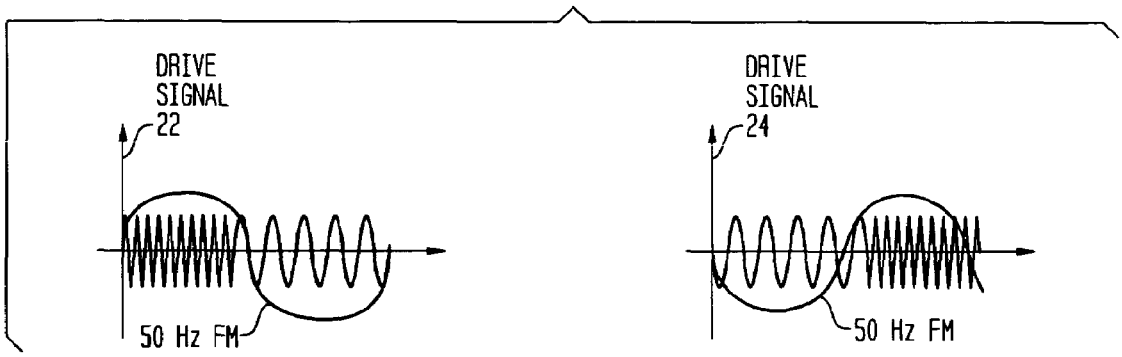
FIG. 7 depicts two same-frequency FM waves propagated 180° out-of-phase with one another for the drive signals.

Another drive signal approach is depicted in FIG. 7 where drive signals 22 and 24 are 50 Hz FM waves propagated 180° out-of-phase with one another. This dual FM drive signal approach has been found to move the liquid in tank 12 very effectively and precisely in terms of the position of the resulting resonation. It is therefore believed that the body (or body part) immersed in tank 12 at the designated target area (e.g., approximately the center of tank 12) will benefit by increased blood movement or flow in a precisely-selected target area of the body.

The apparatus for creating each of drive signals 22 and 24 can be realized using a variety of commercially-available frequency generators, amplifiers and controllers in configurations that would be well understood by one of ordinary skill in the art. The input signal source program can be adjusted over time by an operator on site, or can be provided by a pre-programmed source which could combine one or more of the above-described input signals in a prescribed sequence.

Figure 8:
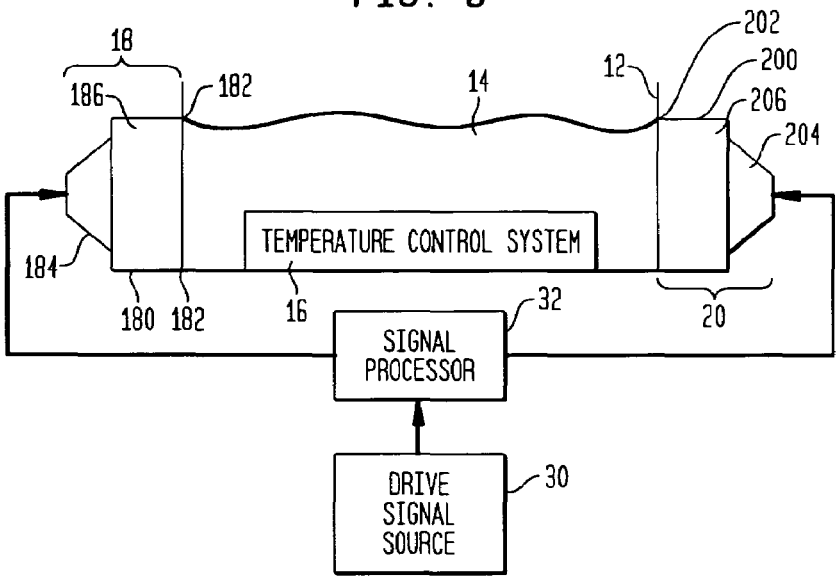
FIG. 8 is a schematic view of another embodiment of an acoustically-driven hydrotherapy system in accordance with the present invention in which a single signal source is used to drive each of the acoustic systems.

As mentioned above, each of drive signals 22 and 24 could also originate from a single source. For example, as illustrated in FIG. 8, a single drive signal source 30 is used to drive acoustic drivers 184 and 204. Note that if each of drivers 184 and 204 receives the same source signal in the same phase, the center of tank 12 will simply resonate in accordance with the input signals' frequency. Accordingly, a signal processor 32 is typically coupled to source 30 to manipulate the source signal provided to acoustic drivers 184 and 204. For example, processor 32 can be used to adjust the phase angle or delay between the signals applied to drivers 184 and 204. It has further been found that by continually adjusting the phase difference between, for example, 170° to 190° (or back and forth about the 180° out-of-phase condition), the center portion of tank 12 experiences vibrational movement thereacross. That is, the resonation in liquid 14 moves back and forth across the center portion of tank 12 in correspondence with the phase angle changes. In this way, a person's body or body part at the center portion of tank 12 is massaged at the surface thereof by the moving resonation while simultaneously receiving penetrating low frequency (i.e., less than approximately 100 Hz) sound waves that are substantially coupled to the body's internal muscle, nerve and bone structure. Further, the present invention's combination of soothing external massage and internal stimulation can be carried out in the comfort of warm liquid 14.

Figure 9:
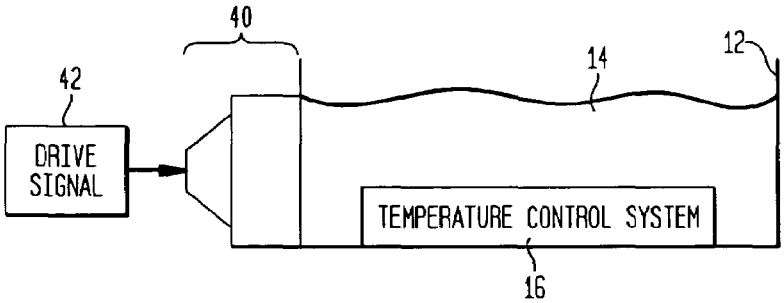
FIG. 9 is a schematic view of another embodiment of an acoustically-driven hydrotherapy system in accordance with the present invention in which a single acoustic system is utilized.

While the present invention as described above offers the greatest degree of benefits, it is not so limited. For example, in situations where less complex vibrational effects are required, a single acoustic system could be used to resonate the tank's liquid. Thus, FIG. 9 illustrates another embodiment of the present invention where a rigid tank 12 filled with liquid 14 has a single acoustic system 40 coupled thereto. Acoustic system 40 functions similarly to each of acoustic systems 18 and 20 and, therefore, will not be described further herein. Drive signal 42 can be any sine wave, FM wave or frequency swept wave as described above. Still further, more than two acoustic systems can be placed about tank 12 to bring about a desired acoustic wave interaction at a desired treatment area in the tank. The acoustic systems can be operated simultaneously or in accordance with specific "on/off" patterns to achieve specific acoustic wave interactions in the tank.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A hydrotherapy system, comprising:

a rigid tank filled with a liquid, said rigid tank having interior walls and exterior walls;

at least one acoustic driver, each said acoustic driver coupled to one of said exterior walls via a sealed air-filled chamber that includes said one of said exterior walls; and controllable signal source means coupled to each said acoustic driver for generating and applying a drive signal thereto, wherein each said acoustic driver generates an acoustic wave in said chamber associated therewith, said acoustic wave impinging on said one of said exterior walls wherein said acoustic wave is coupled to said liquid for transmission therethrough, said acoustic wave interacting in said liquid with at least one of (i) a reflection of said acoustic wave from one of said interior walls, and (ii) at least one other acoustic wave generated by another of said at least one acoustic driver for impingement on another of said exterior walls and subsequent transmission through said liquid.

2. A hydrotherapy system as in claim 1 wherein said rigid tank is made from a material selected from the group consisting of metal, fiberglass, plastic and concrete.

3. A hydrotherapy system as in claim 1 wherein said rigid tank is made from stainless steel.

4. A hydrotherapy system as in claim 1 further comprising means coupled to said liquid for controlling the temperature thereof.

5. A hydrotherapy system as in claim 1 wherein said controllable signal source means generates said drive signals such that said acoustic wave and said at least one other acoustic wave are at frequencies not to exceed approximately 100 hertz.

6. A hydrotherapy system as in claim 1 wherein said controllable signal source means generates said drive signals such that said acoustic wave and said at least one other acoustic wave are FM waves.

7. A hydrotherapy system as in claim 1 wherein said controllable signal source means generates said drive signals such that said acoustic wave and said at least one other acoustic wave are frequency swept FM waves.

8. A hydrotherapy system as in claim 1 wherein said controllable signal source means generates said drive signals such that said acoustic wave and said at least one other acoustic wave are in-phase with one another.

9. A hydrotherapy system as in claim 1 wherein said controllable signal source means generates said drive signals such that said acoustic wave and said at least one other acoustic wave are out-of-phase with one another.

10. A hydrotherapy system as in claim 1 wherein said controllable signal source means generates said drive signals such that said acoustic wave and said at least one other acoustic wave alternate between being in-phase and out-of-phase with one another.

11. A hydrotherapy system, comprising:

a rigid tank filled with a liquid, said rigid tank having interior walls with exterior walls corresponding thereto, said rigid tank further having a first and second of said interior walls opposing one another;

a first acoustic driver coupled via a first sealed air-filled chamber to a first of said exterior walls corresponding to said first of said interior walls, a portion of said first of said exterior walls forming a wall of said first sealed air-filled chamber;

a second acoustic driver coupled via a second sealed air-filled chamber to a second of said exterior walls corresponding to said second of said interior walls, a portion of said second of said exterior walls forming a wall of said second sealed air-filled chamber; and controllable signal source means coupled to said first acoustic driver and said second acoustic driver for generating and applying drive signals thereto, wherein said first acoustic driver generates a first acoustic wave that impinges on said first exterior wall and is coupled to said liquid for transmission therethrough, and wherein said second acoustic driver generates a second acoustic wave that impinges on said second exterior wall and is coupled to said liquid for transmission therethrough, said first acoustic wave interacting with said second acoustic wave in said liquid.

12. A hydrotherapy system as in claim 11 wherein said rigid tank is made from a material selected from the group consisting of metal, fiberglass, plastic and concrete.

13. A hydrotherapy system as in claim 11 wherein said rigid tank is made from stainless steel.

14. A hydrotherapy system as in claim 11 further comprising means coupled to said liquid for controlling the temperature thereof.

15. A hydrotherapy system as in claim 11 wherein said controllable signal source means generates said drive signals such that said first acoustic wave and said second acoustic wave are at frequencies not to exceed approximately 100 hertz.

16. A hydrotherapy system as in claim 11 wherein said controllable signal source means generates said drive signals such that said first acoustic wave and said second acoustic wave are FM waves.

17. A hydrotherapy system as in claim 11 wherein said controllable signal source means generates said drive signals such that said first acoustic wave and said second acoustic wave are frequency swept FM waves.

18. A hydrotherapy system as in claim 11 wherein said controllable signal source means generates said drive signals such that said first acoustic wave and said second acoustic wave are in-phase with one another.

19. A hydrotherapy system as in claim 11 wherein said controllable signal source means generates said drive signals such that said first acoustic wave and said second acoustic wave are out-of-phase with one another.

20. A hydrotherapy system as in claim 11 wherein said controllable signal source means generates said drive signals such that said first acoustic wave and said second acoustic wave alternate between being in-phase and out-of-phase with one another.

* * * * *